US007416090B2

(12) United States Patent
Mooney et al.

(10) Patent No.: US 7,416,090 B2
(45) Date of Patent: Aug. 26, 2008

(54) ROUND TYPE HOT FILLABLE CONTAINER WITH DEFORMABLE LABEL PANEL

(75) Inventors: Michael Mooney, Frankfort, IL (US); Satya Kamineni, Westmont, IL (US)

(73) Assignee: Constar International Inc., Philadelphia, PA (US)

( * ) Notice: Subject to any disclaimer, the term of this patent is extended or adjusted under 35 U.S.C. 154(b) by 144 days.

(21) Appl. No.: 10/961,554

(22) Filed: Oct. 8, 2004

(65) Prior Publication Data

US 2006/0076310 A1 Apr. 13, 2006

(51) Int. Cl.
*B65D 1/02* (2006.01)
*B65D 1/40* (2006.01)

(52) U.S. Cl. ..... 215/381; 215/383; 215/384; 215/365; 220/669; 220/675

(58) Field of Classification Search ..... 215/381–384, 215/365; 220/669, 675
See application file for complete search history.

(56) References Cited

U.S. PATENT DOCUMENTS 4,387,816 A * 6/1983 Weckman ..... 215/381
4,946,053 A 8/1990 Conrad
5,690,244 A * 11/1997 Darr ..... 215/382
5,740,934 A * 4/1998 Brady ..... 215/381
5,971,184 A * 10/1999 Krishnakumar et al. ..... 215/384
D497,545 S * 10/2004 Knight et al. ..... D9/667
6,838,138 B1 * 1/2005 Akiyama et al. ..... 428/35.7
7,014,056 B2 * 3/2006 Trude ..... 215/381
2002/0008077 A1 * 1/2002 Lane et al. ..... 215/381
2003/0015491 A1 * 1/2003 Melrose et al. ..... 215/381
2004/0016716 A1 * 1/2004 Melrose et al. ..... 215/381
2005/0121408 A1 * 6/2005 Deemer et al. ..... 215/381
2006/0065618 A1 * 3/2006 Pedmo et al. ..... 215/381

FOREIGN PATENT DOCUMENTS

WO WO 99/21770 * 5/1999

* cited by examiner

*Primary Examiner*—Sue A Weaver
(74) *Attorney, Agent, or Firm*—Wilmer Cutler Pickering Hale & Dorr LLP

(57) ABSTRACT

An improved hot fillable container includes a bottom and a sidewall connected with the bottom so as to define an internal space. The sidewall is shaped so as to define in transverse cross-section in at least one location a substantially circular outer circumference. The sidewall further includes first and second convex label panel portions each having a convexly curved outer surface. Advantageously, the sidewall is constructed and arranged so that deformation of the sidewall in response to a partial vacuum condition within the internal space will occur primarily in the convex label panel portions. The structure permits the hot fillable container to be constructed without the use of concave vacuum panel portions.

15 Claims, 3 Drawing Sheets

ROUND TYPE HOT FILLABLE CONTAINER WITH DEFORMABLE LABEL PANEL

BACKGROUND OF THE INVENTION

1. Field of the Invention

This application relates to blow-molded containers, and more particularly to round type hot-fillable containers that are constructed to flexibly accommodate volumetric contraction that will occur in response to cooling of product within the container.

2. Description of the Related Technology

Perishable food and beverage products such as fruit juices are typically filled at elevated temperatures, such as 180 to 190 degrees Fahrenheit, under variable pressure conditions into specially designed plastic containers in what is conventionally referred to as the hot-fill process. Container designs that are intended for use with this process are referred to as hot fill type containers. After filling, the containers are sealed, preventing mass transfer into and out of the container. As the product within the containers cools, the volume that is occupied by the product decreases, thereby inducing a partial vacuum within the container that exerts an inward force upon the sidewall of the container. The design of hot fill type containers is heavily influenced by the necessity of managing this shrinkage during cooling. In the past, the shrinkage has most commonly been accommodated by molding one or more concave vacuum panel areas into the sidewall of the container that are designed to deflect inwardly as the product cools. By substantially limiting the deformation to the vacuum panel areas, unwanted distortion of other portions of the container is prevented.

While container designs relying upon vacuum panels have been effective in many ways, certain limitations and disadvantages are associated with their use, including limitations as to the possible variations in the exterior styling of the container, the need to provide enough plastic material to form the vacuum panels with the requisite thickness, and incompatibility with certain types of package labeling processes. For example, it is difficult to use certain types of pressure sensitive labeling on conventional round type hot fillable containers that have prominent vacuum panels.

A need exists for an improved hot fillable container design that obviates the various limitations and disadvantages of conventional hot fill container designs that have concave vacuum panels.

SUMMARY OF THE INVENTION

Accordingly, it is an object of the invention to provide an improved hot fillable container design that obviates the various limitations and disadvantages of conventional hot fill container designs that have concave vacuum panels.

In order to achieve the above and other objects of the invention, a hot fillable container that is constructed according to a first aspect of the invention includes a bottom; and a sidewall connected with the bottom so as to define an internal space. The sidewall is shaped so as to define in transverse cross-section in at least one location a substantially circular outer circumference. The sidewall further includes at least one convex structural portion having a convexly curved outer surface. The sidewall is further constructed and arranged so that deformation of the sidewall in response to a partial vacuum condition within the internal space will occur primarily in the convex structural portion.

According to a second aspect of the invention, a hot fillable container includes a bottom; and a sidewall connected with the bottom so as to define an internal space. The sidewall is shaped so as to define in transverse cross-section in at least one location a substantially circular outer circumference. The sidewall further includes first and second convex label panel portions each having a convexly curved outer surface. The sidewall is constructed and arranged so that deformation of the sidewall in response to a partial vacuum condition within the internal space will occur primarily in the convex label panel portions.

A hot fillable container according to a third aspect of the invention includes a bottom; and a sidewall connected with the bottom so as to define an internal space, the sidewall being shaped so as to define in transverse cross-section a substantially circular outer circumference. The sidewall further includes a convex structural portion that has a first area that is constructed and arranged to flex in a first manner in response to deformation of said sidewall caused by an a partial vacuum within said internal space, a second area that is constructed and arranged to flex in a second manner in response to such a partial vacuum and a hinge location at a boundary between the first and second areas.

According to a fourth aspect of the invention, a hot fillable container includes a bottom; and a sidewall connected with the bottom so as to define an internal space, the sidewall being shaped so as to define in transverse cross-section in at least one location a substantially circular outer circumference. The sidewall is further constructed and arranged to flexibly deform in response to partial vacuum conditions within the internal space, and wherein the sidewall contains no concave vacuum panel portions that will substantially flex in response to the partial vacuum conditions.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
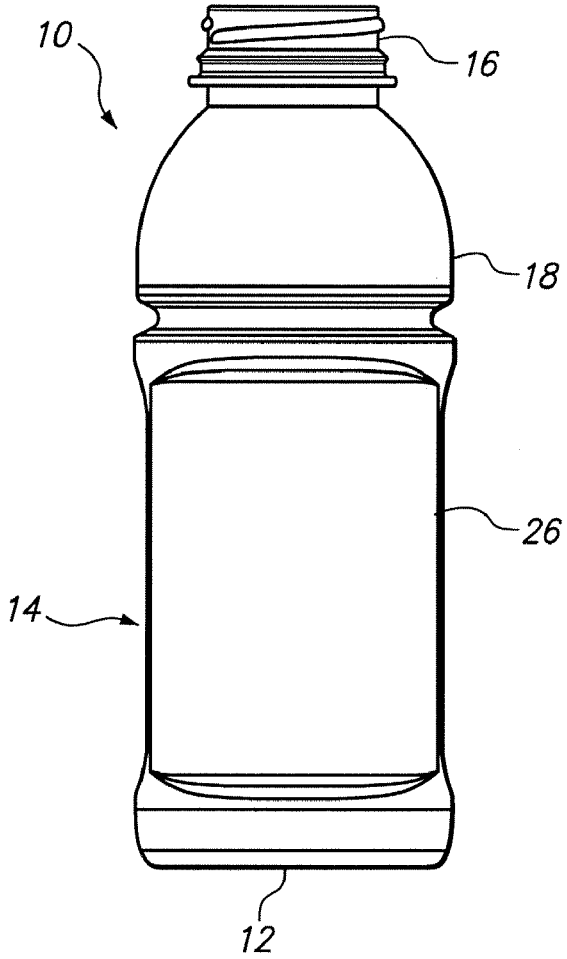
FIG. 1 is a front elevational view of the container that is constructed according to a preferred embodiment of the invention.
Figure 2:
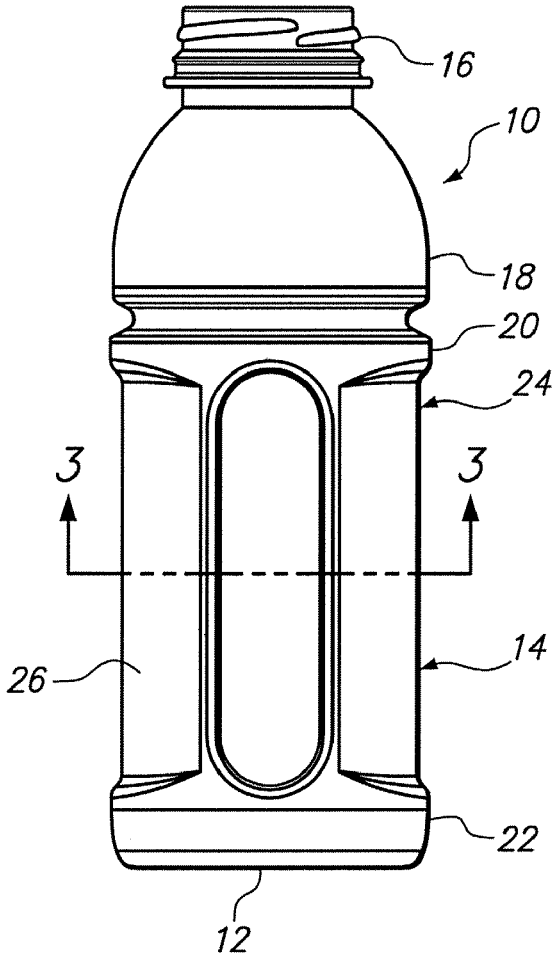
FIG. 2 is a side elevational view of the container that is depicted in FIG. 1.
Figure 3:
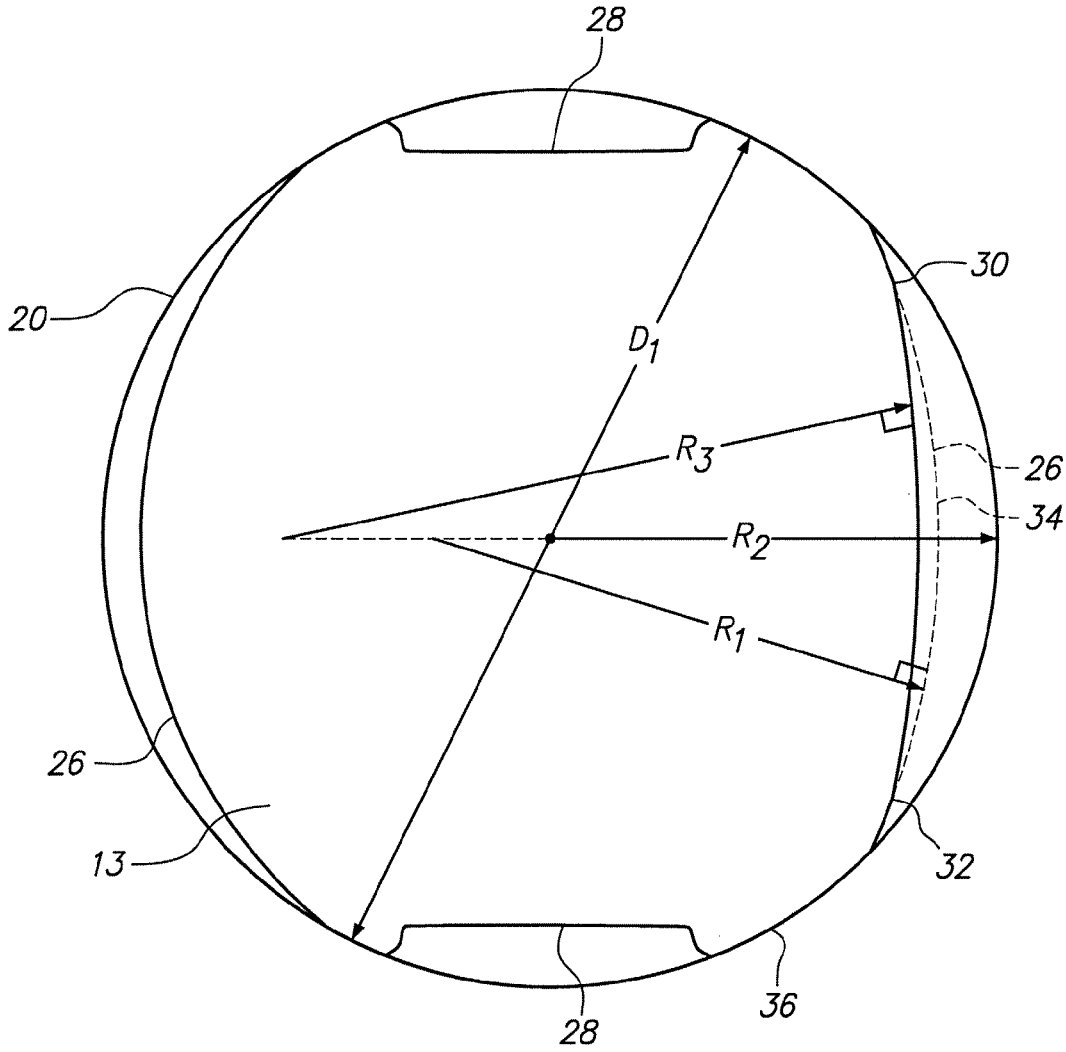
FIG. 3 is a diagrammatical cross-sectional view depicting flexure of the container that is depicted in FIGS. 1 and 2 during and after the hot fill process.

Referring now to the drawings, wherein like reference numerals designate corresponding structure throughout the views, and referring in particular to FIG. 1, a hot fillable container 10 that is constructed according to a preferred embodiment of the invention includes a bottom 12 and a sidewall 14 that is connected with the bottom 12 so as to define an internal space 13 in which a substance such as a fruit juice may be introduced. As is shown in FIGS. 1 and 2, hot fillable container 10 includes a threaded finish portion 16, a neck portion 18 and upper and lower round portions 20, 22, each of which has a substantially circular cross-section. Hot fillable container 10 is thus considered a round type container for purposes of this document; if placed on its side it may be rolled smoothly over a flat surface. The outer radius of the upper round portion 20 is depicted in FIG. 3 as radius R2, which will be discussed in greater detail below. Hot fillable container 10 is preferably fabricated from a plastic material such as polyethylene terephthalate.

Hot fillable container 10 is further configured to have a central label portion 24 that is positioned between the upper and lower round portions 20, 22. Central label portion 24 includes a pair of structural sidewall portions 26 that have a convexly curved outer surface. According to one important aspect of the invention, sidewall 14 is constructed so that deformation thereof in response to the partial vacuum condition that is created after the hot fill process will occur primarily in the structural sidewall portions 26. In the preferred embodiment of the invention, sidewall 14 further includes an opposing pair of recessed side portions 28 that are shaped so as to enhance grippability of the container 10. In the preferred embodiment of the invention, the two structural sidewall portions 26 are substantially symmetrical with respect to each other, as are the pair of opposed recessed side portions 28. Preferably, the structural sidewall portions 26 subtend at least 120° of the circumference of the sidewall 14, and more preferably subtend at least 180° of their circumference of the sidewall 14. Structural sidewall portions 26 preferably have been outer surface that is substantially linear in at least one location in longitudinal cross-section.

As is best shown in FIG. 3, hot fillable container 10 has an outer diameter D1 as measured at the outer circumference of the upper and lower round portions 20, 22. As is further shown in FIG. 3, each of the structural sidewall portions 26 have an original radius of curvature R1, which is preferably greater than the outer radius of the hot fillable container 10, which is equal to one half of the outer diameter D1. During the hot fill process, the container 10 is filled with a liquid such as a fruit juice at elevated temperatures, such as 180 to 190 degrees Fahrenheit, under variable pressure conditions as are specified by the beverage manufacturer. After filling, the container 10 is sealed, preventing mass transfer into and out of the container 10. As the product within the container 10 cools, the volume that is occupied by the product decreases, thereby inducing a partial vacuum within the container 10 that exerts an inward force upon the sidewall 14 of the container. As this occurs, deformation of the sidewall 14 will be substantially confined to the structural sidewall portions 26, which will assume a new radius of curvature R3 after cooling. Preferably, the new radius of curvature R3 will be greater than the original radius of curvature R1.

As the structural sidewall portions 26 undergo flexure, natural hinge lines 30, 32 are defined that remain substantially stationary during this fiexure. These natural hinge lines 30, 32 are positioned as shown in FIG. 3 at the two locations on each of the structural sidewall portions 26 at which the curves having radii of curvature Rl and R3, respectively, intersect. Each of the natural hinge lines 30 contains an infinite number of hinge points located along possible transverse cross-sections of the label panel portions 24 of the container 10. The natural hinge lines 30, 32 may be considered as a boundary between a first portion 34 of the convex structural portion 26 and a pair of second, outer portions 36 of the convex structural portion 26. The second, outer portions 36 of the convex structural portions 26 undergo little fiexure during the hot fill process, and may optionally be structurally reinforced, such as by adding circumferentially extending ribbing or equivalent reinforcement.

Figure 4:
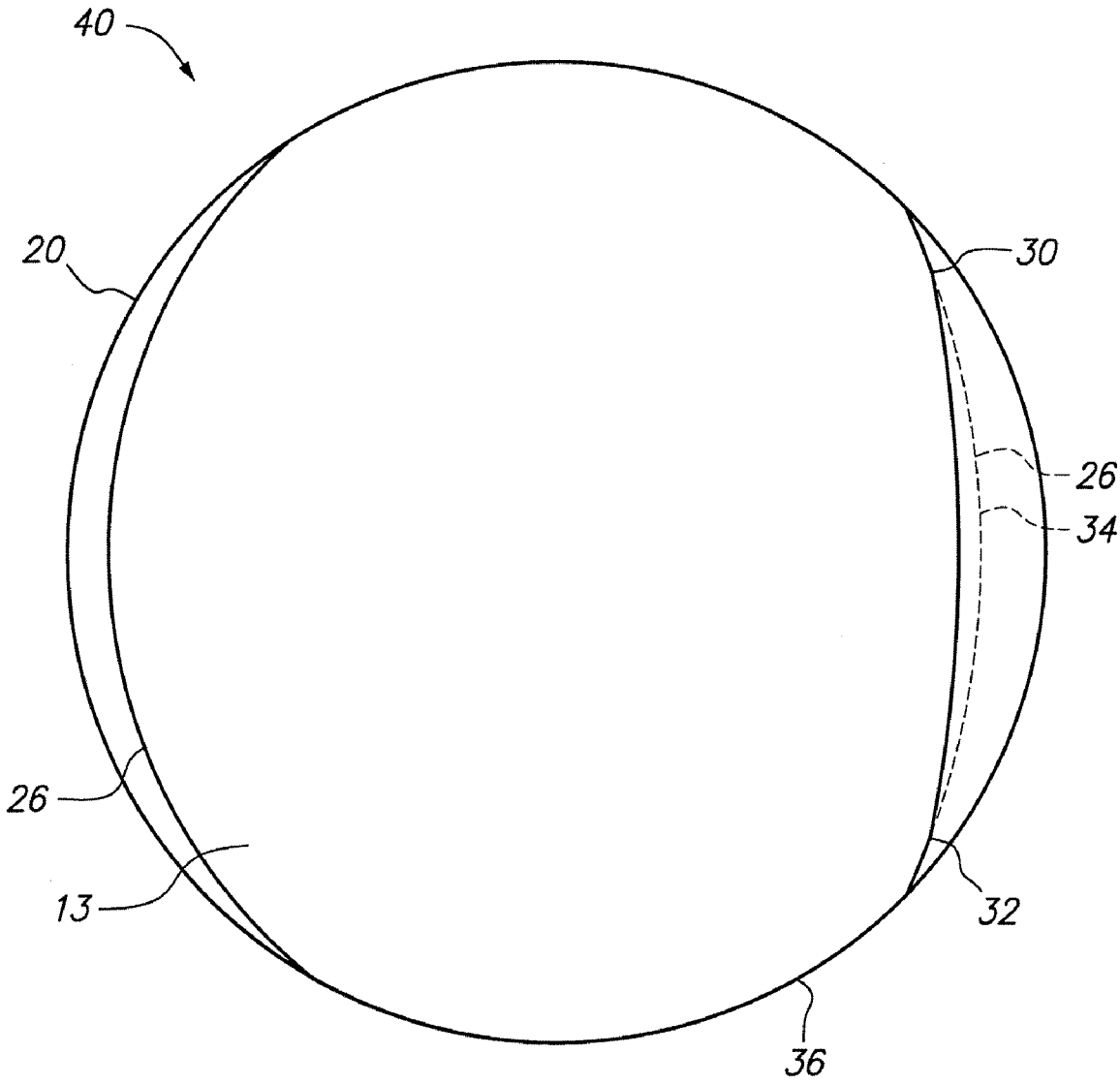
FIG. 4 is a diagrammatical cross-sectional view depicting an alternative embodiment of the invention.

FIG. 4 depicts an alternative embodiment of the invention showing a container 40 that is substantially identical to the embodiment that is shown in FIG. 3 except for the absence of recessed side portions 28.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hot fillable container, comprising:

a bottom; and a sidewall connected with said bottom so as to define an internal space, said sidewall being shaped so as to define in transverse cross-section in at least one location a substantially circular outer circumference, said sidewall further comprising at least one convex structural label panel portion having a convexly curved outer surface, said sidewall being constructed and arranged so that deformation of said sidewall in response to a partial vacuum condition within said internal space will occur primarily in said convex structural label panel portion, and wherein said convex structural label panel portion comprises:

a first part that deforms in response to a partial vacuum condition within said internal space so as to have an increased radius of curvature;

a second part that deforms in response to a partial vacuum condition within said internal space so as to have a decreased radius of curvature; and a hinge point located at a boundary between said first part of said convex structural portion and said second part of said convex structural portion.

2. A hot fillable container according to claim 1, wherein said convex structural portion is convex when viewed in transverse cross-section.

3. A hot fillable container according to claim 1, wherein said sidewall is constructed and arranged so that deformation of said sidewall in response to a partial vacuum condition within said internal space will occur substantially exclusively in said convex structural portion.

4. A hot fillable container according to claim 1, wherein said sidewall is constructed and arranged so that no concave outer surface thereof will undergo substantial deformation in response to a partial vacuum condition within said internal space.

5. A hot fillable container according to claim 1, further comprising stiffening means for stiffening at least one part of said convex structural portion.

6. A hot fihlable container according to claim 5, wherein said stiffening means comprises at least one rib molded into said convex structural portion.

7. A hot fillable container according to claim 1, wherein said sidewall comprises at least two of said convex structural label panel portions.

8. A hot fillable container according to claim 7, wherein said convex structural portions are substantially symmetrical with respect to each other.

9. A hot fillable container according to claim 7, wherein said convex structural portions are convex along a transverse cross-section, and wherein said convex structural portions subtend at least 120 degrees of the circumference of the sidewall.

10. A hot fillable container according to claim 9, wherein said convex structural portions subtend at least 180 degrees of the circumference of the sidewall.

11. A hot fillable container according to claim 1, wherein said convex structural portion has an outer surface that is substantially linear in at least one location in longitudinal cross-section.

12. A hot fillable container according to claim 1, wherein said sidewall is fabricated of polyethylene terephthalate.

13. A hot fillable container, comprising:

a bottom;

a sidewall connected with said bottom so as to define an internal space, said sidewall being shaped so as to define in transverse cross-section in at least one location a substantially circular outer circumference, said sidewall further comprising:

first and second convex label panel portions each having a convexly curved outer surface; and first and second recessed side portions, said first and second recessed side portions each being located between said first and second convex label panel portions around said circular outer circumference; and wherein said sidewall is constructed and arranged so that deformation of said sidewall in response to a partial vacuum condition within said internal space will occur primarily in said convex label panel portions, such that said label panel portions remain convex after said deformation.

14. A hot fillable container, comprising:

a bottom;

a sidewall connected with said bottom so as to define an internal space, said sidewall being shaped so as to define in transverse cross-section a substantially circular outer circumference, said sidewall further comprising a convex structural label panel portion, said convex structural label panel portion having a first label panel area that is constructed and arranged to flex in a first manner in response to deformation of said sidewall caused by a partial vacuum within said internal space, a second label panel area that is constructed and arranged to flex in a second manner in response to such a partial vacuum, such that the said convex label panel portion remains convex after said deformation, and a hinge location at a boundary between said first and second label panel areas, said sidewall further defining at least one recessed side portion.

15. A hot fillable container according to claim 14, wherein a radius of said hinge location remains unchanged in response to deformation induced by the partial vacuum within said internal space.

* * * * *